US010172759B2

(12) United States Patent
Cappiello Rodriguez et al.

(10) Patent No.: US 10,172,759 B2
(45) Date of Patent: Jan. 8, 2019

(54) ADJUSTABLE ELBOW CRUTCH WITH CURVED ARM AND OVAL SECTION

(71) Applicant: VIDCAPP ITHEF SL, Madrid (ES)

(72) Inventors: Miguel Cappiello Rodriguez, Madrid (ES); Rafael Videl Vidal Rodriguez, Serracines (ES); Daniel Berdun Barbero, Madrid (ES)

(73) Assignee: VIDCAPP ITHEF SL, Madrid (ES)

( * ) Notice: Subject to any disclaimer, the term of this patent is extended or adjusted under 35 U.S.C. 154(b) by 100 days.

(21) Appl. No.: 13/875,004

(22) Filed: May 1, 2013

(65) Prior Publication Data

US 2014/0326285 A1 Nov. 6, 2014

Related U.S. Application Data

(63) Continuation of application No. PCT/ES2010/070793, filed on Dec. 1, 2010.

(51) Int. Cl.
*A61H 3/02* (2006.01)
*A61H 3/00* (2006.01)

(52) U.S. Cl.
CPC ..... *A61H 3/02* (2013.01); *A61H 2003/006* (2013.01); *A61H 2003/007* (2013.01); *A61H 2201/0192* (2013.01)

(58) Field of Classification Search
CPC ..... A45B 9/02; A61H 3/02; A61H 2003/007; A61H 2201/0192; A61H 2003/006
USPC ..... 135/65, 68, 71–73, 76, 82; 482/67; 602/16, 20, 27
See application file for complete search history.

(56) References Cited

U.S. PATENT DOCUMENTS

| | | | | | |
|---|---|---|---|---|---|
| 2,192,766 | A | * | 3/1940 | Cederstrom | 135/71 |
| 2,516,852 | A | * | 8/1950 | Burry et al. | 135/71 |
| 2,711,183 | A | * | 6/1955 | Lofstrand, Jr. | 135/69 |
| 2,736,330 | A | * | 2/1956 | Wood | 135/68 |
| 2,741,255 | A | | 4/1956 | Neptune | |
| 2,811,978 | A | * | 11/1957 | Russell | 135/65 |
| 2,817,348 | A | * | 12/1957 | Holliday, Jr. | 135/71 |
| 3,606,898 | A | * | 9/1971 | Harocopo | 35/68 |
| 3,635,233 | A | * | 1/1972 | Robertson | 135/71 |
| 3,710,807 | A | * | 1/1973 | Ferry | 135/68 |
| 5,038,811 | A | * | 8/1991 | Gilmore | 135/71 |

(Continued)

FOREIGN PATENT DOCUMENTS

| | | | |
|---|---|---|---|
| DE | 29909915 | U1 | 8/1999 |
| FR | 940436 | A | 12/1948 |

(Continued)

*Primary Examiner* — Winnie Yip
(74) *Attorney, Agent, or Firm* — Browdy and Neimark, P.L.L.C.

(57) ABSTRACT

Adjustable elbow crutch with a main single piece that acts as leg-arm on which a handle and cuff are fixed, for which the handle includes an opening through which the leg-arm passes, said opening constituting an anchor for the handle on the leg-arm, where furthermore the leg-arm is made out of composite material, with an oval cross-section, and the leg-arm disposes of an initial lower segment that is vertical and which is followed in its upper part by a curved segment which defines a support angle. In this way a crutch is obtained that is light, easy to handle, easy and safe to adjust, which covers a continuous range of adjustments and which covers the largest number of possible user categories.

11 Claims, 2 Drawing Sheets

(56) References Cited

U.S. PATENT DOCUMENTS

| | | | | | |
|---|---|---|---|---|---|
| 5,331,989 | A | | 7/1994 | Stephens | |
| 5,351,702 | A | * | 10/1994 | Denjean | 135/71 |
| 5,711,334 | A | * | 1/1998 | Roux | 135/65 |
| D394,148 | S | * | 5/1998 | Hosick | D3/8 |
| 5,924,434 | A | * | 7/1999 | Cato, III | 135/68 |
| D552,245 | S | * | 10/2007 | Davis | D24/188 |
| 7,503,337 | B1 | * | 3/2009 | Morgan et al. | 135/70 |
| 2004/0055629 | A1 | * | 3/2004 | Evans | 135/68 |

FOREIGN PATENT DOCUMENTS

| | | | | | |
|---|---|---|---|---|---|
| JP | 2008272389 | A | * | 11/2008 | |
| WO | 2006/047413 | A2 | | 5/2006 | |
| WO | WO 2008010346 | A1 | * | 1/2008 | A61H 3/02 |
| WO | 2008139671 | A1 | | 11/2008 | |

* cited by examiner

ADJUSTABLE ELBOW CRUTCH WITH CURVED ARM AND OVAL SECTION

CROSS REFERENCE TO RELATED APPLICATIONS

This utility patent application filed under 35 USC § 111 is a continuation of international application PCT/ES2010/070793 filed on Dec. 1, 2010, which is incorporated by reference herein.

TECHNICAL FIELD

This invention pertains to medical devices for ambulatory assistance such as crutches.

BACKGROUND

The main structure of a crutch basically consists of 4 pieces: 3 straight circular section tubes, where one of the tubes performs the function of the leg, and the other two tubes joined to the first perform the function of handle and arm support and are joined to the straight tube by a T-shaped piece, to which the leg and the arm support form a determined angle.

The definition of leg and arm for elbow crutches, according to European Standard EN ISO 11334-1:2007 and its Spanish equivalent UNE-EN ISO 11334-1, are described as:

Arm: Part of the crutch that is above the rear reference point of the handgrip.

Leg: Part of the crutch that is below the rear reference point of the handgrip.

Handgrip: Part of the crutch envisaged by the manufacturer to be gripped by the hand when the crutch is used.

Handle: Part of the crutch where the handgrip is attached.

Rear reference point of the handgrip: Point next to the rear position limit where the length of the handle ends With a double adjustment system, the leg and arm length settings are done in steps by way of springs which fit into holes found in the structure of the leg and arm support. The adjustment of the leg is performed using a telescopic mechanism whose length is fixed using a system of bolts with springs which fit into the holes found along the length of the tubes which form the telescope.

A simple design type consists of an adjustable telescopic leg and a piece which performs the functions of arm-support, handle and cuff. In this design, the arm is not adjustable and is referred to as leg adjustable only.

Other special designs exist in which the crutch is not adjustable, in order to reduce weight and favour user comfort.

All these known designs result in a range of crutches which each weigh between 500 g and 1000 g.

Furthermore, the current standard on elbow crutches specifies the minimum safety requisites to which the design and production must comply, without taking into account important factors related to user comfort.

The current user of crutches either habitual or sporadic, often has to pick up the crutch from the floor after simple tasks such as opening a door; an operation that is both uncomfortable and extremely difficult for older people or those with back problems.

In addition to the problems of stability mentioned, such as constant dropping on the floor, crutches hitherto known are heavy and difficult to manage.

Other difficulties presented by current crutches are related to the materials employed in their production. As they are made from metallic materials, they are heavy and susceptible to corrosion and deterioration and, as a result, degrade over time causing irritating noises when used.

Other problems presented by crutches currently found on the market is the relationship of the adjustment of the cuff, which is done by steps, which is to say rather inadequate and cannot be carried out continuously, being a mechanism where the position selection is performed by springs which deteriorate and add more noise during use.

There are ultra light crutches (composite or titanium) which need to be tailor made in the factory to meet the requirements of the end user as they cannot be adjusted in any way once they reach the user.

One known crutch type is that disclosed in patent U.S. H2138H, in which the crutch is described as carbon made with three interconnected graphite/epoxy tubes upon which a handle and a cuff is permanently fixed, with no possibility of undertaking any adjustments to the position and fixing of the handle and the cuff on the arm.

As a result, the object of this invention is to develop a crutch such as that which is described below, which overcomes the problems described, so as to prevent it from falling to the floor, so that it is not too heavy, so that user comfort is improved in as far as use and handling are concerned, so that it does not deteriorate at such a fast rate as those we are familiar with up to now, so that continuous adjustment is possible and not by jumps or steps, and ultimately so that it is adaptable to all the possible physical characteristics of the user and that the cost is relatively low.

SUMMARY

As the title of the invention establishes, the object of this invention is an adjustable elbow crutch with curved arm and oval section, with an elbow crutch understood to be a walking aid consisting of a leg, handle and a non horizontal support for the forearm.

This invention is characterised by the special configuration and design of the crutch, in addition to the materials employed, resulting in a lightweight crutch; it is made from materials which guarantee durability over time and a design which improves handling.

As a result, this invention falls within the category of crutches and in particular within the design characteristics and materials used in the design and production of crutches.

The object of the invention is an adjustable elbow crutch with curved arm and oval section.

With this crutch which is the object of this invention, the leg and the arm are a single piece, and as such have always been hitherto referred to as a leg-arm.

The adjustable elbow crutch, the object of the invention, is composed of:

a leg-arm made as a single piece
a cuff
a handle
a handgrip
a tip

As a complementary and optional extra, the crutch is available with a means of attaching the crutch to the user, with the aim of preventing the crutch from falling.

Additionally and also optional, the crutch is available with a handle and a handgrip in one single piece, that is to say, a handle-handgrip.

The leg-arm of the crutch is made as a single piece, without moveable telescopic parts for height adjustment, disposing of a straight segment which is followed in the upper part by an arched or curved segment, creating an oval cross-section, where furthermore the straight segment and the curved segment are contained within the same plane and the curved segment is continuously curved without discontinuities or sudden changes.

The upper part is in an arched shape; it is curved along its entire length and can entail different curve radiuses, being a preferred embodiment the generation of the curved segment starting from the circumferential arc with a determined range of curve.

The cuff is fitted on the upper part of the leg-arm under pressure, while the handle disposes of an opening, through which the leg-arm can pass, with the repositioning of both the handle and the cuff being possible along the length of the curved segment of the leg-arm, allowing the most suitable position for the user to be chosen.

Equally, as with the handle, the cuff in one possible embodiment could dispose of a structure in which an opening is present through which the leg-arm can pass, with the repositioning of the cuff along the length of the curved segment being possible.

The fixing of the handle in each position is achieved due to a combination of two physical effects, on the one hand, the reaction force which the curved area of the leg exerts on the handle when the handle is subjected to a load and, on the other hand, the static friction force which is exerted by the inside face of the handle orifice and the leg-arm itself.

Due to the fact that the leg-arm has an oval cross-section, in at least the curved segment, the fixing of the cuff and the handle to the leg-arm, in addition to impeding movement along the length of the leg-arm, cannot be broken on a horizontal plane. As a result, the fixing of the handle and the cuff on the leg-arm is obtained without the need of additional means of attachment, such as screws or similar devices.

The tip is fixed to the lower end of the leg-arm, and remains fixed under pressure.

As a result, derived from the design of the leg-arm and the type of joint of both the handle and the cuff, it is possible to adjust the handle and the cuff within a range of continuous values without the need of attachment parts such as rivets, screws or bolts. This range of continuous adjustment allows it to be perfectly adaptable to the physical characteristics of each user.

With the objective of producing a crutch of minimum weight, the main part, which we have called the leg-arm, is made from one single piece, without telescopic movable parts for height adjustment.

To allow better adjustment and be better adapted to the user, it is possible to adjust the handle and the cuff along the leg-arm in both directions and be fixed at the desired point, that is to say, continuous adjustment is possible.

Furthermore, with the objective of increasing the capacity to adjust the device, so that it covers the largest number of possible user categories, a simplified shape is obtained consisting of a straight segment followed by a curved segment, which in one possible embodiment could be generated from a circumferential arc, which has a curve radius and spans an arc and which falls within a range in which practically all types of people are covered.

It is important to emphasise that the only way to obtain a single piece crutch which is height adjustable is with a crutch that has a straight segment followed by a curved segment.

Due to the characteristics described, a crutch is obtained that is very light, easy to handle and assemble, which does not require additional means for fixing the handle and the cuff on the leg-arm, where the leg-arm is made from a single piece and with which continuous adjustment is possible along the length of the curved segment of the crutch, allowing ergonomic improvements and is adaptable to virtually all possible users.

DESCRIPTION OF THE DRAWINGS

To complete the description that is being made and with the object of assisting in a better understanding of the characteristics of the invention, in accordance with a preferred example of practical embodiment thereof, accompanying said description as an integral part thereof, is a set of drawings wherein, by way of illustration and not restrictively, the following has been represented.

DETAILED DESCRIPTION OF PREFERRED EMBODIMENTS

Proceeding in view of the figures mentioned, a way of preferred embodiment of the invention is stated, but in no way restrictive.

Figure 1:
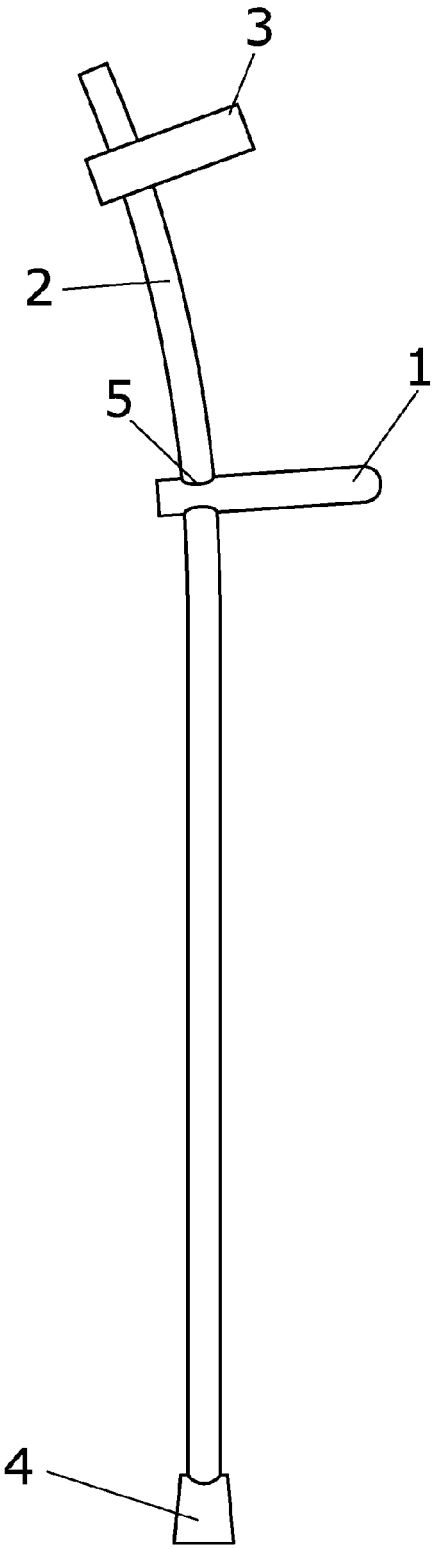
In FIG. 1, a representation is shown of the crutch which is the object of this invention, where the different parts of the crutch can be appreciated as in the design thereof.

As can be seen in FIG. 1, the crutch which is the object of this invention disposes of a main single piece which operates as leg-arm (2) on which a handle (1) and a cuff (3) are fixed, for the purpose of which the handle (1) disposes of a opening through which the leg-arm (2) passes, said opening constituting an anchor (5) for the handle (1) on the leg-arm (2).

On the handle (1) a handgrip may be available which, in one possible embodiment, could consist of a single piece.

The leg-arm (2) is made out of composite material, enabling the entire composition of the crutch to weigh less than 160 grams. Additionally, another important design characteristic which contributes to obtaining the intended aims, is that the cross-section of the leg-arm is oval, which ensures better fixing of the handle (1) through its anchor (5), as well as impeding the handle from turning in a horizontal direction and the cuff through its vertical axis, in such a way that some pieces, like the cuff, can operate under pressure without the need for screws, rivets or any other fastening elements, which increase weight and complicate assembly.

The crutch also disposes of a means of attaching the crutch to the user, which could be adhesive means, Velcro®, or a bracelet or cord which joins a part of the crutch to a part of the body of the user, so that the crutch does not fall and remains in a manageable position for the user. This fact is possible due to the lightness of the crutch; otherwise it would be uncomfortable for the user.

The moveable parts of the crutch are the handle (1) and the cuff (3), having a single degree of freedom along the length of the leg-arm, which allows the necessary movement for adjustment, each one separately with respect to the leg-arm (2).

The fixing of the handle (1) on the leg-arm (2) is achieved by the sum of two physical effects. Firstly, the reaction force which the curved area of the leg-arm exerts on the handle when subject to a load, due to the effect of the oval cross-section. And secondly, the static friction force which the anchoring piece exerts on the curved area of the leg.

Additionally, and in a complementary way, the surface in contact of both the handle and the cuff with the leg-arm (2) disposes of or is made from an non-skid material, so as to ensure the fixing of the handle and the cuff.

The cuff (3) and the tip (4) remain fitted to the leg-arm (1) under pressure.

Figure 2:
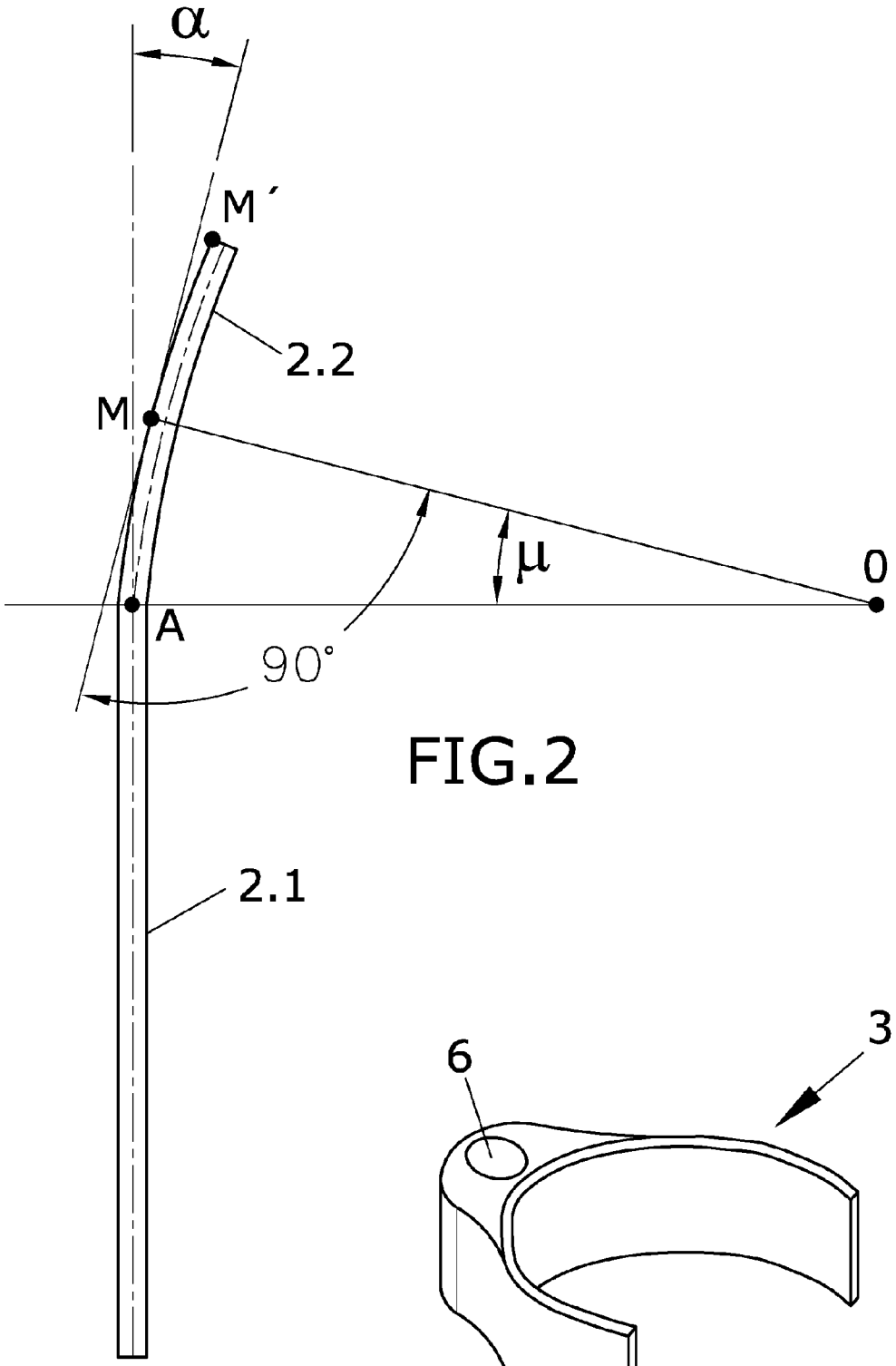
In FIG. 2, a representation is shown of how the design of the crutch is obtained and the degree of variable support that can be obtained.

In FIG. 2, it can be observed that the leg-arm (2) disposes of an initial lower segment (2.1) that is vertical and which is followed in its upper part by a curved segment (2.2). By varying the length of the lower vertical segment (2.1), all possible users are covered (from children to adults), always maintaining, with any length of vertical segment (2.1), the possibility of adjusting the position of the handle (1) and the cuff (3) on the curved segment (2.2).

In one possible embodiment, the curved segment (2.2) could be a circumferential arc that has a curve radius within a range of between 90 cm and 110 cm, spanning said curved segment (2.2) an arc between 19.5° and 27.5°, so that the total length of the curved area (2.2) would be between 340 mm and 480 mm. These ranges are not restrictive, but are aimed at including the range that would cover the largest number of possible users.

In FIG. 2, it can be observed that the support angle $\alpha$ for point M, defined as the angle that forms the tangent to the curved segment for point M with the vertical, with said angle $\alpha$ equal to angle $\mu$ formed between the radius OM with the horizontal AM. Resulting in the conclusion that the range of support angles would practically coincide with the angle that spans the arc of the curved area (2.2).

The elements of handle (1) and cuff (3) are adjusted on the total curve A-M-M', selecting the positions that are most comfortable or convenient for the user.

The distance between the cuff (3) and the handle (1) must be between 160 mm and 240 mm, according to various anthropometric studies carried out, taking a perimeter equivalent to 200 mm as a possible total support surface.

In one possible embodiment, the arc of the curved segment (2.2) spans a total angle of 23.5°, the total perimeter length of the curved area (2.2) therefore being some 400 mm. The support angle $\alpha$, defined as the angle between the vertical and the tangent traced through point M, would be equivalent to the angle $\mu$ through the relationship of perpendicularity of the sides. In this case, as M is the middle point of the curve, the support angle would be 11.75°.

It can be understood by observing this FIG. 2, that given that M moves on the support surface towards M', the angle $\mu$ increases in value and given that the distance of the handle and the cuff is maintained, the base of the new rectangular triangle will be the radial that passes through the axis of the handle again obtaining that $\alpha=\mu$.

Figure 3:
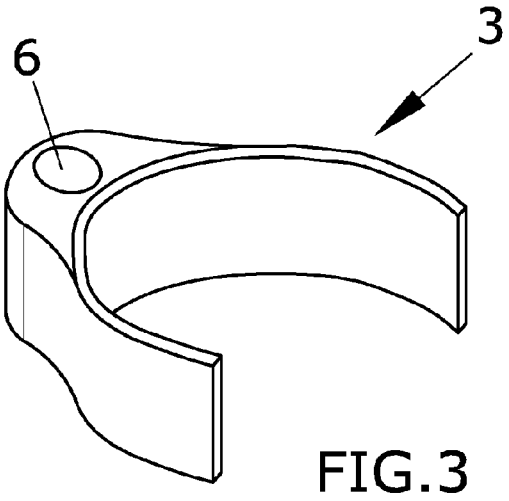
In FIG. 3, a representation of the cuff in perspective is shown respectively.

It can be observed in the FIG. 3, a possible embodiment of the cuff (3) for its fixing on the leg-arm (2) which, as in the case of the handle, disposes of an opening (6) with an equal section to the cross-section of the leg-arm (2), so that the leg-arm (2) passes through the opening (6) of the cuff (3), enabling the most comfortable and ergonomic position for the user to be selected.

The essential nature of this invention is not altered with variations in materials, shape, size and layout of the component elements, described non restrictively, with this being sufficient for its reproduction by an expert.

The invention claimed is:

1. Adjustable elbow crutch, comprising:

a main single piece configured as a leg-arm having an oval cross-section, wherein the leg-arm includes an initial lower segment that is vertical which is followed in its upper part by a curved segment along its entire length, both segments being contained in the same plane;

a handle attached to the leg-arm wherein the handle includes an opening through which the leg-arm passes, said opening constituting an anchor for the handle on the leg-arm; and a cuff attached to the leg-arm piece;

wherein the handle and the cuff are adjusted along the curved segment of the leg arm within a range of continuous values; and the curved segment includes a circumferential arc that has a curve radius within a range of between 90 cm and 110 cm, while the curved segment spans the circumferential arc within a range of between 19.5° and 27.5°.

2. Adjustable elbow crutch, according to claim 1, wherein the cuff remains fitted on the leg-arm under pressure.

3. Adjustable elbow crutch, according to claim 1, wherein the distance between the cuff and the handle is between 160 mm and 240 mm, creating a total perimeter length of the curved area between 340 mm and 480 mm.

4. Adjustable elbow crutch, according to claim 1, wherein a surface in contact with both the handle and the cuff and the leg-arm is covered by an adhesive material.

5. Adjustable elbow crutch, according to claim 1, wherein the leg-arm is made of a composite material.

6. Adjustable elbow crutch, according to claim 1, further comprising a handgrip on the handle, with handle and handgrip comprising a single piece.

7. Adjustable elbow crutch according to claim 1, wherein the handle comprises a structure with an opening of equal section to the cross-section of the leg-arm.

8. The adjustable elbow crutch of claim 1, wherein the circumferential arc of the curved segment spans a total angle of 23.5°, a total perimeter length of the curved segment (2.2) therefore being some 400 mm.

9. The adjustable elbow crutch of claim 1, wherein a support angle ($\alpha$) of the curved segment coincides with an angle that spans the circumferential arc of the curved segment wherein the support angle ($\alpha$) for a point (M) along the arc, defined as the angle that forms a tangent to the curved segment for the point (M) with a vertical axis of the initial lower segment, with said support angle ($\alpha$) equal to an angle ($\mu$) formed between the curved radius (OM) for the point (M) of the arc with a horizontal radius (AM) for a point of the vertical initial lower segment, wherein (O) is a vertex of angle ($\mu$) and (A) is a vertex of angle ($\alpha$).

10. Adjustable elbow crutch which disposes of a main single piece that acts as leg-arm (2) on which a handle (1) and cuff (3) are fixed, for which the handle (1) disposes of an opening through which the leg-arm (2) passes, said opening constituting an anchor (5) for the handle (1) on the leg-arm (2), characterised in that:

the leg-arm (2) is made of a single piece, with an oval cross-section, where also the leg-arm (2) disposes of an initial lower segment (2.1) that is vertical which is followed in its upper part by a curved segment (2.2) along its entire length, both segments being contained in the same plane, and the handle (1) and the cuff (3) are adjusted along the curved segment of the leg arm (2) within a range of continuous values;

wherein a support angle ($\alpha$) of the curved segment coincides with an angle spans a circumferential arc of the curved segment wherein the support angle ($\alpha$) for a point (M) along the arc, defined as the angle that forms a tangent to the curved segment for the point (M) with a vertical axis of the initial lower segment, with said support angle ($\alpha$) equal to an angle ($\mu$) formed between a curved radius (OM) for the point (M) with a horizontal radius (AM) for a point of the vertical initial lower segment, wherein (O) is a vertex of angle ($\mu$) and (A) is a vertex of angle ($\alpha$).

11. The adjustable elbow crutch of claim 10, wherein the circumferential arc of the curved segment spans a total angle of 23.5°, a total perimeter length of the curved segment (2.2) therefore being some 400 mm.

* * * * *